US009281575B2

(12) United States Patent
Matsumura et al.

(10) Patent No.: US 9,281,575 B2
(45) Date of Patent: Mar. 8, 2016

(54) TERMINAL

(71) Applicant: YAZAKI CORPORATION, Minato-ku, Tokyo (JP)

(72) Inventors: Kaoru Matsumura, Shizuoka (JP); Tomoyoshi Fukaya, Shizuoka (JP); Kenji Kajikawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/854,425

(22) Filed: Sep. 15, 2015

(65) Prior Publication Data

US 2016/0006136 A1 Jan. 7, 2016

Related U.S. Application Data

(63) Continuation of application No. PCT/JP2014/056931, filed on Mar. 14, 2014.

(30) Foreign Application Priority Data

Mar. 21, 2013 (JP) ..... 2013-057758

(51) Int. Cl.

| | |
|---|---|
| ***H01R 4/18*** | (2006.01) |
| ***H01R 13/422*** | (2006.01) |
| ***H01R 13/436*** | (2006.01) |
| ***H01R 13/04*** | (2006.01) |

(52) U.S. Cl.

CPC ..... *H01R 4/184* (2013.01); *H01R 13/04* (2013.01); *H01R 13/422* (2013.01); *H01R 13/4226* (2013.01); *H01R 13/4362* (2013.01); *H01R 4/185* (2013.01)

(58) Field of Classification Search

CPC ..... H01R 13/4362; H01R 13/4326; H01R 13/184

USPC ..... 439/884, 752, 866

See application file for complete search history.

(56) References Cited

U.S. PATENT DOCUMENTS

| | | | | | |
|---|---|---|---|---|---|
| 5,989,079 | A * | 11/1999 | Seko | H01R 13/057 | 439/884 |
| 6,089,928 | A * | 7/2000 | Miwa | H01R 13/4362 | 439/752 |
| 6,790,106 | B2 * | 9/2004 | Ito | H01R 13/04 | 439/884 |
| 6,872,093 | B2 * | 3/2005 | Fukatsu | H01R 13/4362 | 439/752 |
| 2003/0100230 | A1 * | 5/2003 | Tsuji | H01R 13/4223 | 439/752 |
| 2004/0253881 | A1 | 12/2004 | Sakurai et al. | | |
| 2008/0146090 | A1 * | 6/2008 | Shimizu | H01R 43/16 | 439/842 |

FOREIGN PATENT DOCUMENTS

| | | | |
|---|---|---|---|
| JP | 2003-317842 | A | 11/2003 |
| JP | 2005-005109 | A | 1/2005 |
| JP | 2008-153074 | A | 7/2008 |
| JP | 2010-102831 | A | 5/2010 |
| JP | 2012-221576 | A | 11/2012 |

* cited by examiner

*Primary Examiner* — Briggitte R Hammond
(74) *Attorney, Agent, or Firm* — Mots Law, PLLC

(57) ABSTRACT

A terminal is formed by bending a plate of electrically conductive metal and is received in a connector housing. The terminal includes a box-shaped body part, a terminal contact part provided on a front side of the body part, and an electrical wire connecting part provided on a rear side of the body part. When the plate before bending is viewed from the thickness direction, a conductor section having a cross-section having constant width and thickness extends from the terminal contact part to the electrical wire connecting part.

3 Claims, 8 Drawing Sheets

TERMINAL

CROSS REFERENCE TO RELATED APPLICATIONS

This application is a continuation of International Application No. PCT/JP2014/056931, filed Mar. 14, 2014, and based upon and claims the benefit of priority from Japanese Patent Application No. 2013-057758, filed Mar. 21, 2013, the entire contents of all of which are incorporated herein by reference.

TECHNICAL FIELD

The present application relates to a terminal housed in a connector housing.

BACKGROUND

As a conventional terminal of this kind, there is one disclosed in JP 2008-153074 A (PTL 1). As illustrated in FIGS. 1 and 2, a male terminal 50 as a conventional terminal is formed by bending a conductive metal plate of a predetermined shape. The male terminal 50 includes a box-shaped body part 51, a terminal contact part 70 provided on a front side of the body part 51, and an electric wire connecting part 71 provided on a rear side of the body part 51.

The body part 51 includes a bottom wall 52, a pair of a first side wall 53 and a second side wall 54 which are raised from both side ends of the bottom wall 52, a top wall 55 which is extended from the first side wall 53, and an auxiliary wall 56 which is extended from the second side wall 54.

On the top wall 55, a hole 59 for forming a stabilizer 57 and an engagement section 58 is formed. The stabilizer 57 is integrally provided from a part of the top wall 55. The engagement section 58 is formed by a portion of the top wall 55 on the front side of the hole 59, and the front end face of the hole 59 is made as an engagement face 58*a*. Inside the hole 59 is made as an entry space for an elastic lance (not illustrated).

On the auxiliary wall 56, a cutout portion 61 is formed. The cutout portion 61 is formed in a shape that approximately coincides with the opening of the hole 59. That is, it is dimensioned such that it does not close the opening of the hole 59.

When the male terminal 50 is inserted into a terminal housing chamber of a connector housing (not illustrated), the stabilizer 57 serves as a guide by being inserted in a guide groove inside the connector housing, and prevents insertion in a direction other than a proper terminal direction (such as a direction that is turned upside down). The elastic lance is engaged with the engagement section 58 in a state that the male terminal 50 is housed in the terminal housing chamber. Thus, the male terminal 50 is fixed so as not to come off from the terminal housing chamber.

SUMMARY

In the conventional male terminal 50, the hole 59 for forming the stabilizer 57 and the engagement section 58 is provided on the top wall 55. Therefore, it is necessary that the hole 59 has a dimension that is equal to or greater than the length dimension of the stabilizer 57 or the entry space for the elastic lance, whichever dimension is greater, and it usually becomes a long dimensioned hole. Therefore, the dimension L2 of the body part 51 becomes long and there is a problem that the body part 51 cannot be downsized.

Also, when the length of the body part 51 is large, the distance from the terminal contact part 70 to a conductive portion with the electric wire of the electric wire connecting part 71 becomes large. This makes an electric resistance of the male terminal 50 large, and it becomes a cause of deteriorating the electrical performance of the male terminal 50.

Accordingly, the present application was made in order to solve the above-mentioned problems and its object is to provide a terminal which can make the electrical resistance small by downsizing the box-shaped body part and which has the improved electrical performance.

A terminal according to an aspect of the present application is formed by bending a plate of conductive metal and housed in a connector housing, and includes: a body part having a box-shape which includes a bottom wall, a first side wall raised from one side end of the bottom wall, a second side wall raised from the other side end of the bottom wall, a top wall extended from the first side wall, and an auxiliary wall extended from the second side wall; a terminal contact part provided on a front side of the body part; an electric wire connecting part provided on a rear side of the body part; a first slit which is provided on the top wall and which opens on a side end face of the top wall; a second slit which is provided on the auxiliary wall and which opens on a side end face of the auxiliary wall; a stabilizer formed by a separated portion on a front side of the second slit of the auxiliary wall; a tab-entry-prevention part formed by a portion on a rear side of the second slit of the auxiliary wall; a stabilizer reinforcing section formed by a separated portion on a front side of the first slit of the top wall; and an engagement section formed by a portion on a rear side of the first slit of the top wall, in which when the plate before bending is viewed from its thickness direction, a conductor section having a cross-section having constant width and thickness extends from the terminal contact part to the electrical wire connecting part.

Preferably, the terminal contact part is provided on a front side of the body part with a tapered coupling part in between, and a bending angle of a side wall portion of the tapered coupling part with respect to the bottom wall is made to gradually become larger as it goes from the body part toward the terminal contact part.

Preferably, the engagement section is formed by raising a place at a part of the top wall more than the other places of the top wall.

According to the terminal according to the aspect of the present application, since the stabilizer reinforcing section, the engagement section, the stabilizer, and the tab-entry-prevention part are provided by forming the first slit on the top wall, forming the second slit on the auxiliary wall, and utilizing the separated portion by the first slit and the separated portion by the second slit without forming a hole as in the conventional terminal, it becomes possible to shorten the dimension in the longitudinal direction of the body part. Accordingly, it is possible to make the electrical resistance small by downsizing the box-shaped body part and the electric performance of the terminal can be improved.

DESCRIPTION OF EMBODIMENTS

Hereinafter, a terminal according to an embodiment of the present application will be explained by referring to FIGS. 3 to 9.

Figure 1:
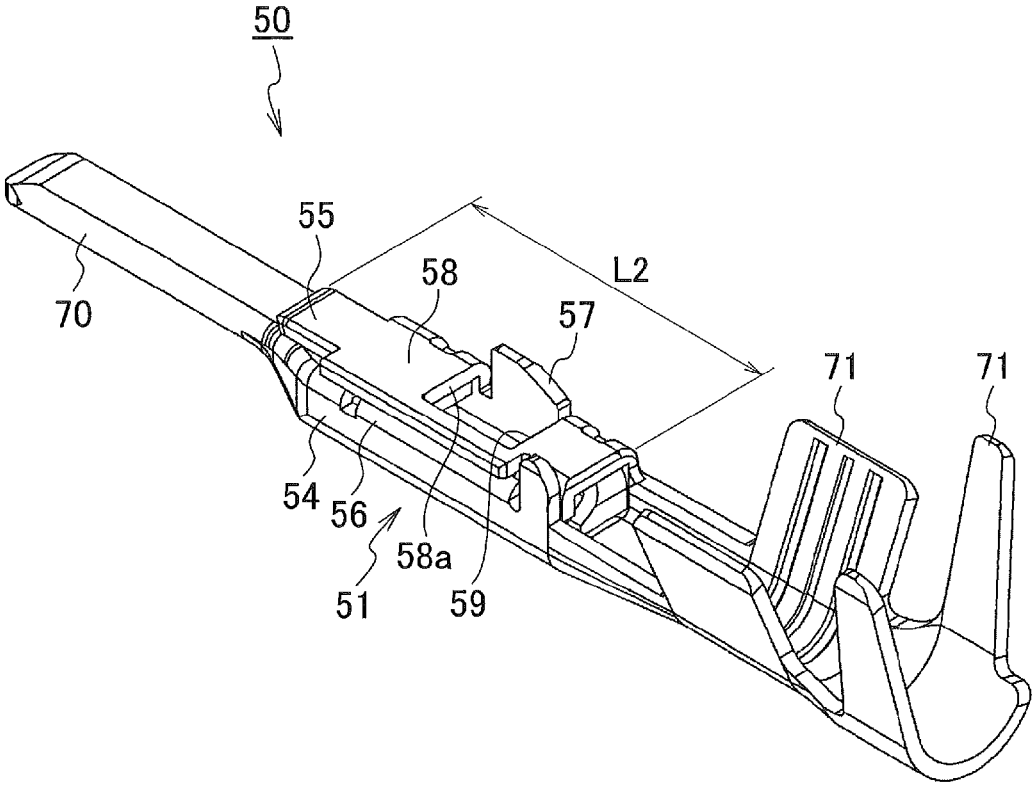
FIG. 1 PRIOR ART
FIG. 1 is a perspective view of a male terminal as a conventional terminal.
Figure 2:
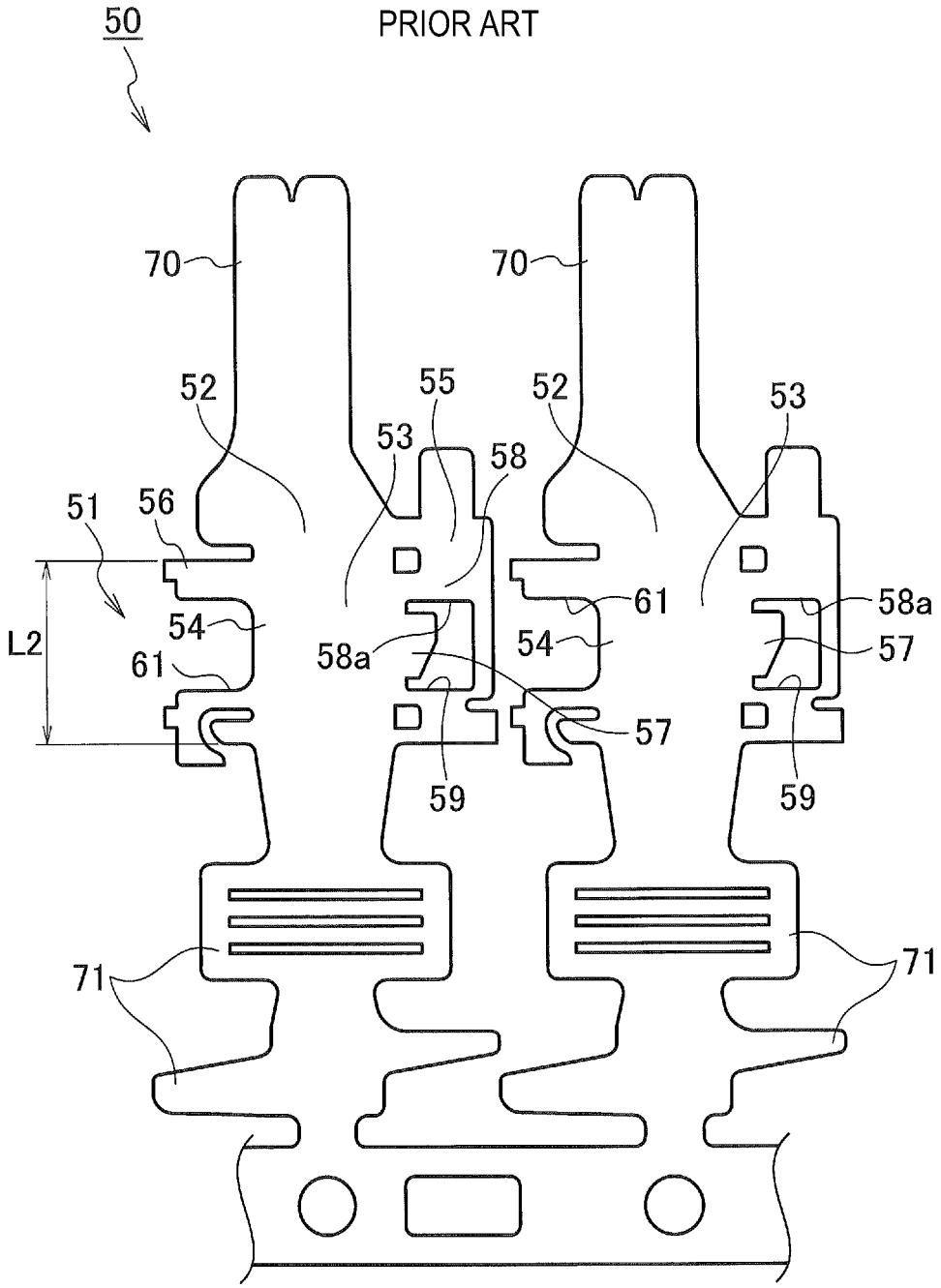
FIG. 2 PRIOR ART
FIG. 2 is a plan view of the male terminals (development view of the male terminals) as the conventional terminal before being folded.
Figure 3A:
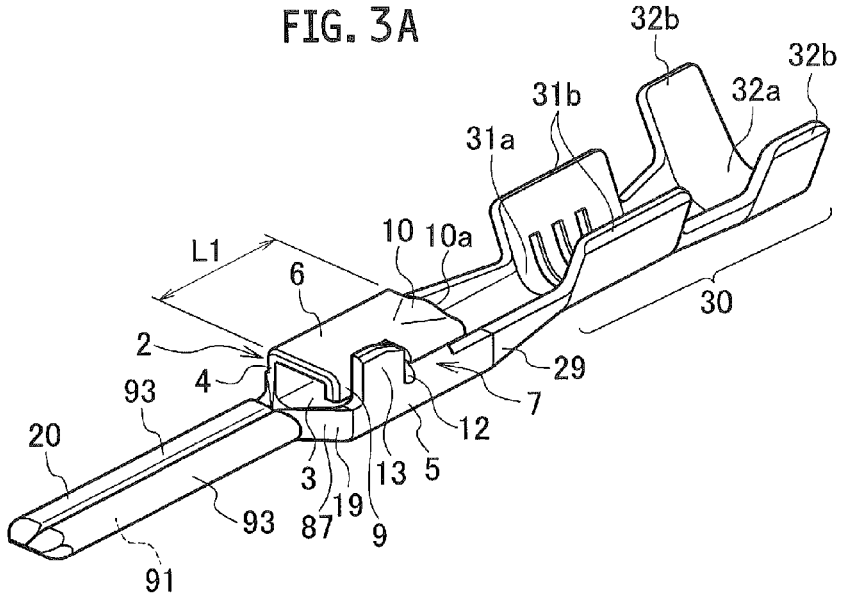
FIG. 3A is a perspective view of a male terminal according to an embodiment.
Figure 3B:
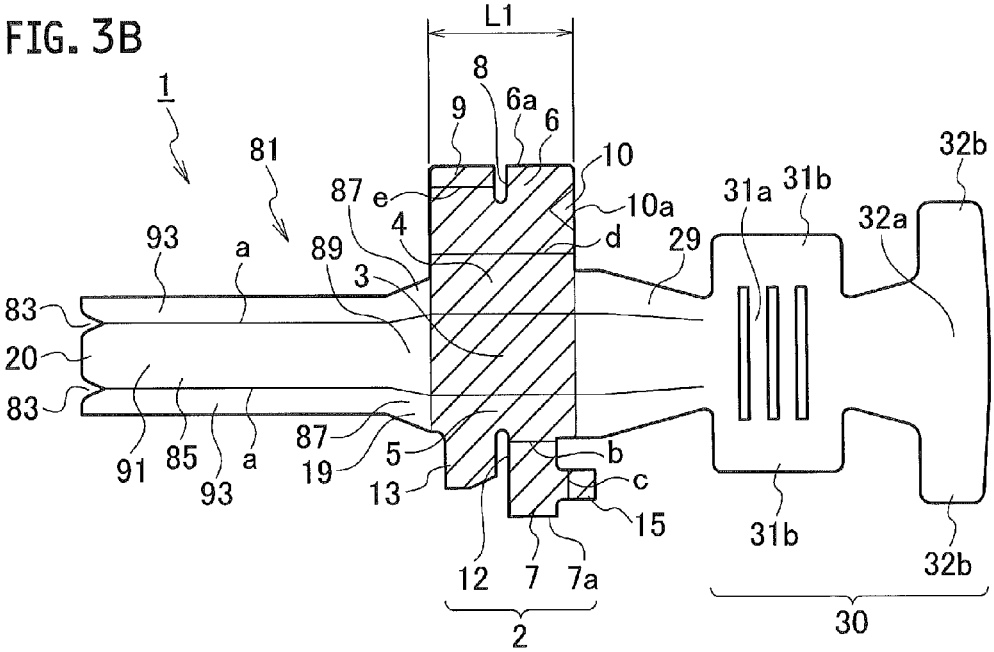
FIG. 3B is a development view of the male terminal according to the embodiment.
Figure 4:
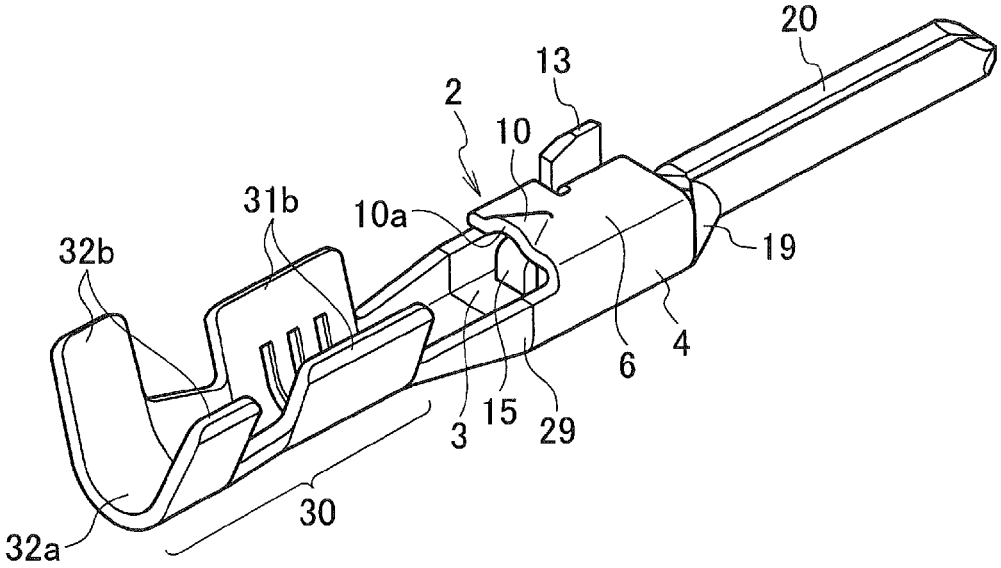
FIG. 4 is a perspective view of the male terminal according to the embodiment viewed from a direction different from FIG. 3A.
Figure 5A:
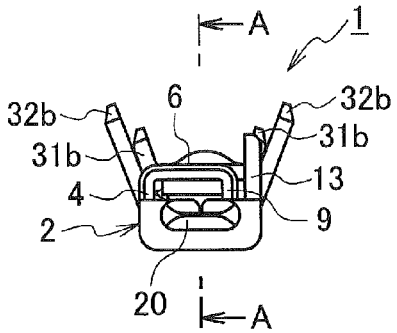
FIG. 5A is a front view of the male terminal according to the embodiment.
Figure 5B:
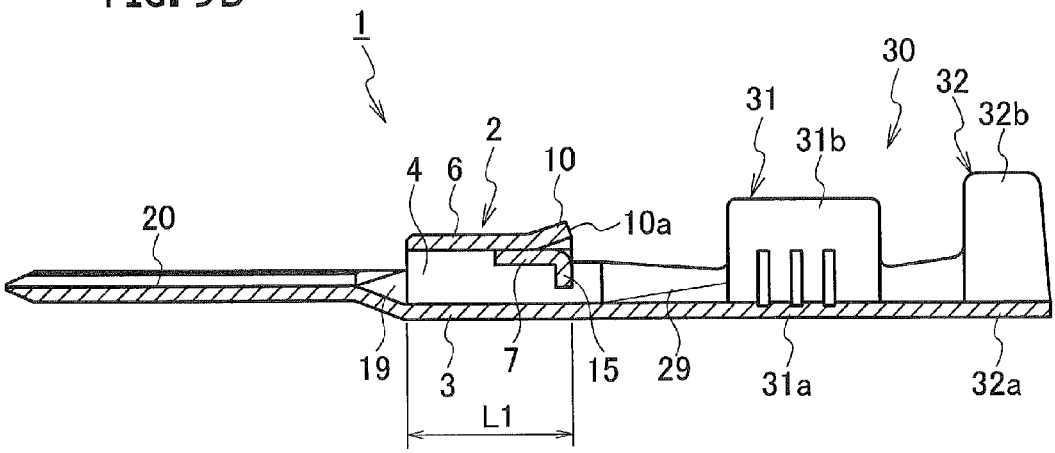
FIG. 5B is a cross sectional view taken along line A-A of FIG. 5A.
Figure 6A:
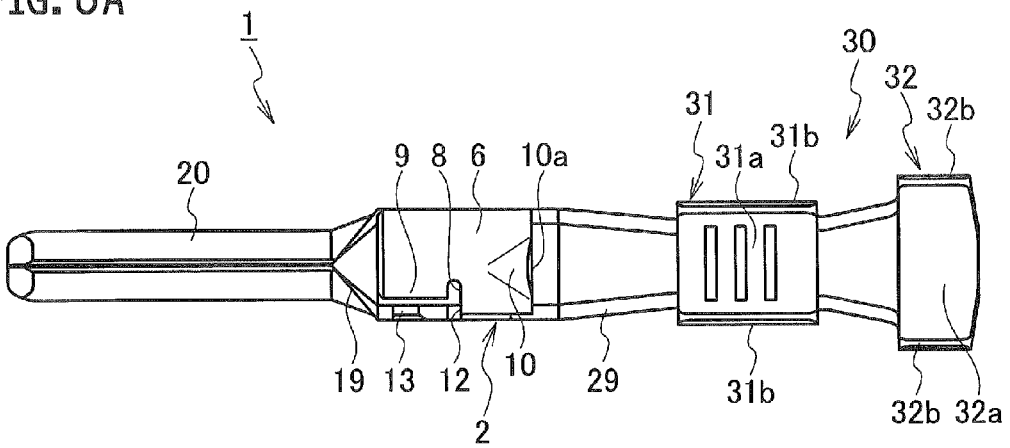
FIG. 6A is a plan view of the male terminal according to the embodiment.
Figure 6B:
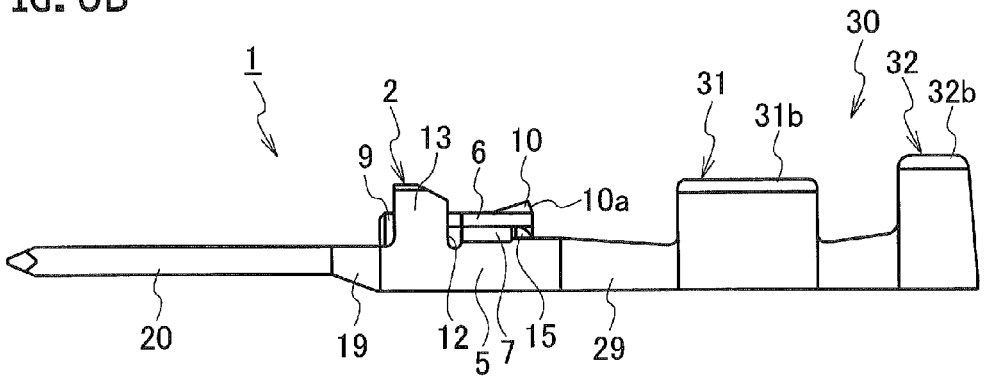
FIG. 6B is a side view of the male terminal according to the embodiment.
Figure 6C:
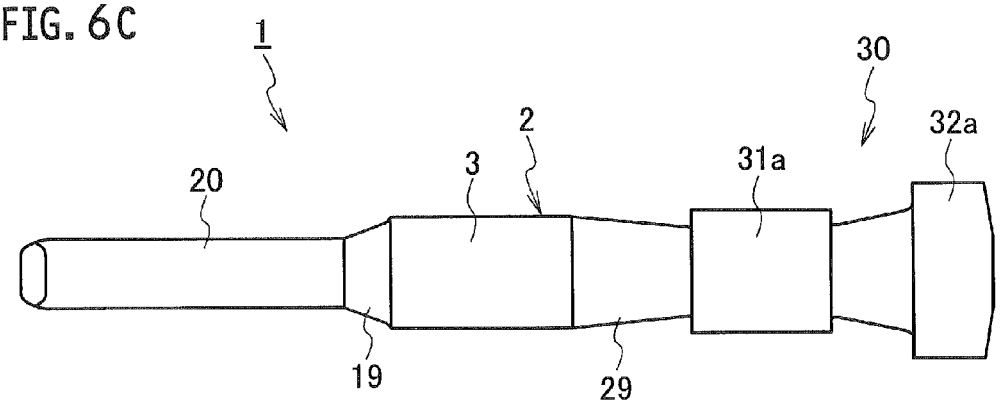
FIG. 6C is a bottom view of the male terminal according to the embodiment.
Figure 9:
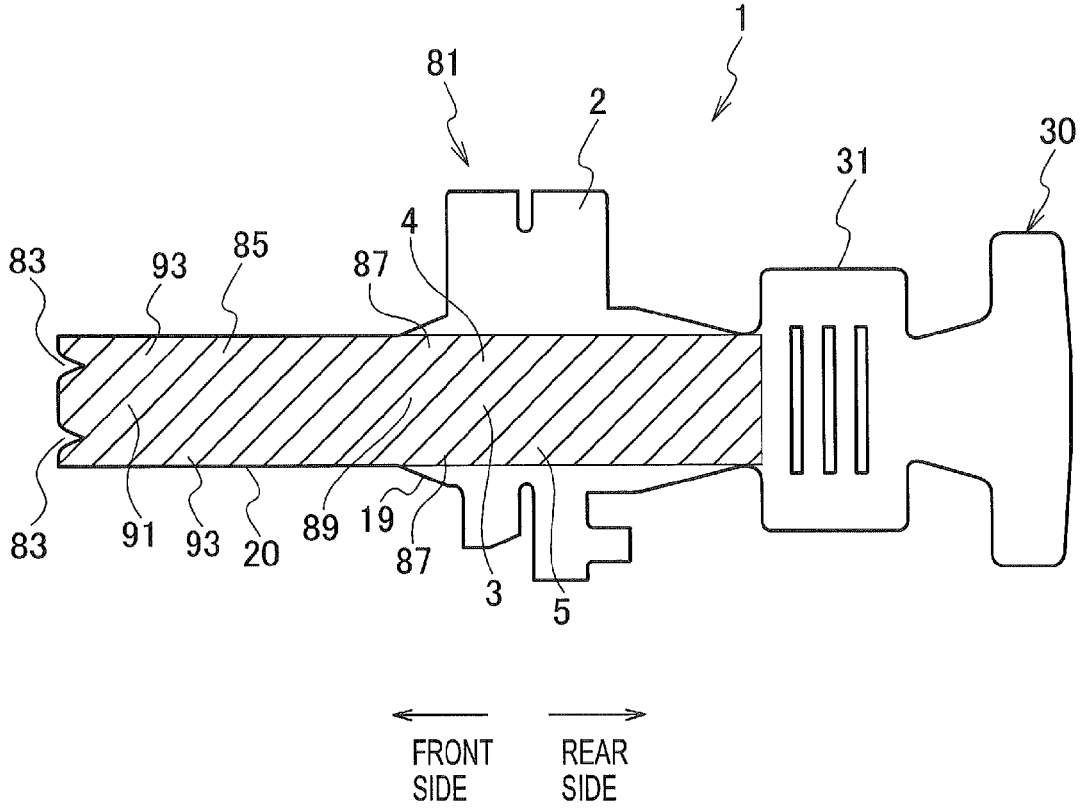
FIG. 9 is a development view of the male terminal similar to FIG. 3B.

As illustrated in FIGS. 3 to 6 and 9, a male terminal 1 as the terminal according to the embodiment is formed by folding a conductive metal plate of a predetermined shape (see FIGS. 3B and 9). That is, the male terminal 1 is formed for example by forming a plate of a predetermined shape (intermediate body 81) by punching a flat metal material having constant thickness, and thereafter applying predetermined bending.

The male terminal 1 includes a box-shaped body part 2, a terminal contact part 20 which is provided on the front side of the body part 2 via a first tapered coupling part 19, and an electric wire connecting part 30 which is provided on the rear side of the body part 2 via a second tapered coupling part 29.

The terminal contact part 20 has a tab shape. The terminal contact part 20 is formed by folding along line "a" of FIG. 3B such that the two faces lie on top of each other.

The electric wire connecting part 30 includes a conductor connecting part 31 and an insulator connecting part 32. The conductor connecting part 31 includes a bottom wall 31*a* and a pair of tongue pieces 31*b* which are protruded from both side ends of the bottom wall 31*a*. The insulator connecting part 32 includes a bottom wall 32*a* and a pair of tongue pieces 32*b* which are protruded from both side ends of the bottom wall 32*a*. Respective bottom walls 31*a*, 32*a* are bent into gradual arc-shapes toward the insides. An electric wire (not illustrated) in a state that its coating is removed at its end, that is, only the conductive part is crimped and fixed to the conductor connecting part 31. The end of the electric wire (not illustrated) that includes the coating as the insulator is crimped and fixed to the insulator connecting part 32.

The body part 2 includes a bottom wall 3, a first side wall 4 raised from one side end of the bottom wall 3, a second side wall 5 raised from the other side end of the bottom wall 3, a top wall 6 which is extended from the first side wall 4, and an auxiliary wall 7 which is extended from the second side wall 5.

The top wall 6 is bent in a horizontal direction with respect to the first side wall 4 along line "d" of FIG. 3B. A first slit 8 which opens on a side end face 6*a* of the top wall 6 is provided at the top wall 6. At the top wall 6, a stabilizer reinforcing section 9 is formed by a separated portion on the front side of the first slit 8. The stabilizer reinforcing section 9 is formed by bending vertically downward along line e of FIG. 3B with respect to the top wall 6. The stabilizer reinforcing section 9 comes close to or comes in contact with a stabilizer 13. Thus, the stabilizer reinforcing section 9 blocks inward deviation or inclination of the stabilizer 13. At the top wall 6, an engagement section 10 is provided at a portion on the rear side of the first slit 8. The engagement section 10 is raised slightly compared to other portions of the top wall 6 by being folded into a triangular shape. A rear end face of the engagement section 10 is made as an engagement face 10*a*. A rear space of the top wall 6, that is, a rear space of the body part 2 is utilized as an entry space for an elastic lance 43.

The engagement section 10 is provided from the rear end of the top wall 6 to the vicinity of this rear end at the central position of the width direction of the top wall 6. Moreover, the width of the top wall 6, when viewed from the thickness direction of the top wall 6, is formed in a triangular shape whose width is wide at the rear end of the top wall 6 and gradually becomes smaller as it comes away from the rear end.

Also, the protrusion height of the engagement section 10 is the highest at a place at the rear end of the top wall 6 in the central position of the width direction of the top wall 6, and gradually becomes lower as it comes away from this highest point.

Furthermore, the engagement section 10 is formed by plastic deformation such that a part of the top wall 6 is raised by embossing or the like.

The auxiliary wall 7 is bent in a horizontal direction with respect to the second side wall 5 along line "b" of FIG. 3B except for the stabilizer 13 as will be described below. The auxiliary wall 7 is arranged on a lower face of the top wall 6 so as to overlap with each other. At the auxiliary wall 7, a second slit 12 which opens on its side end face 7*a* is provided at one place. At the auxiliary wall 7, a stabilizer 13 is formed by a separated portion on the front side of the second slit 12. The stabilizer 13 is arranged straight with respect to the second side wall 5 and protrudes in a vertical direction. At the auxiliary wall 7, a tab-entry-prevention part 15 is provided at a portion on the rear side of the second slit 12. The tab-entry-prevention part 15 is bent vertically downward along line "c" of FIG. 3B with respect to the auxiliary wall 7. The tab-entry-prevention part 15 is arranged so as to close a rear opening of the body part 2.

Figure 7:
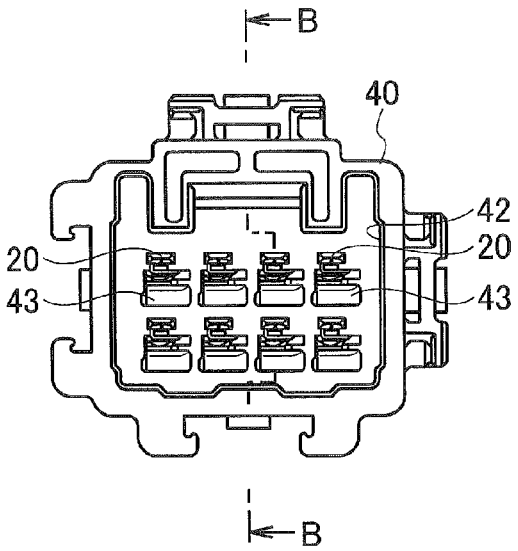
FIG. 7 is a view of a state viewed from the front in which the male terminals according to the embodiment are housed inside the connector housing.
Figure 8:
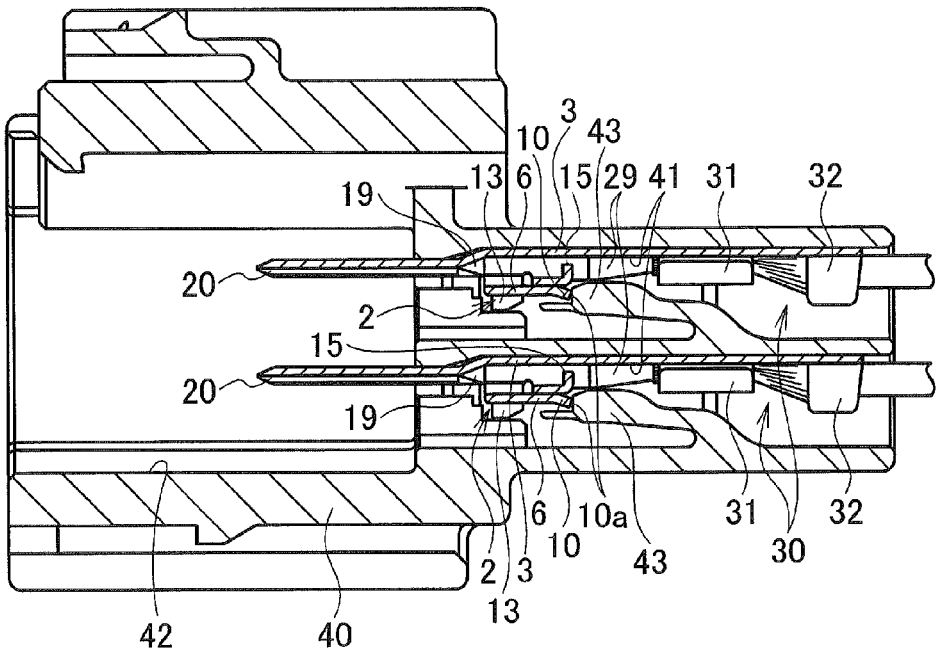
FIG. 8 is a cross sectional view taken along line B-B of FIG. 7.

The male terminal 1 is housed in a connector housing 40, as illustrated in FIGS. 7 and 8. In FIGS. 7 and 8, the connector housing 40 includes a plurality of terminal housing chambers 41, and a connector fitting chamber 42 in which a counterpart connector (not illustrated) can be fitted. Each of the terminal housing chambers 41 is opened to the connector fitting chamber 42 at the front end side thereof, and is opened externally at the rear end side thereof. The connector housing 40 includes elastic lances 43 each provided so as to face each terminal housing chamber 41. The connector housing 40 is provided with guide grooves (not illustrated) each along each terminal housing chamber 41.

Next, a housing operation of the male terminal 1 will be explained. The male terminal 1 is inserted from an opening on the rear side of the terminal housing chamber 41. Then, a front end of the body part 2 of the male terminal 1 interferes with the elastic lance 43 but the elastic lance 43 is flexurally deformed to allow insertion of the male terminal 1. Once the male terminal 1 is inserted up to an insertion completion position, the terminal contact part 20 is protruded in the connector fitting chamber 42 and the elastic lance 43 is returningly deformed so as to be engaged with the engagement section 10. Thus, the male terminal 1 is fixed to the terminal housing chamber 41 while being positioned.

When the male terminal 1 is inserted into the terminal housing chamber 41 of the connector housing 40, the stabilizer 13 serves as a guide by being inserted in the guide groove (not illustrated) inside the connector housing 40, and prevents insertion in a direction other than a proper terminal direction (such as a direction that is turned upside down). The elastic lance 43 is engaged with the engagement section 10 in a state that the male terminal 1 is housed in the terminal housing chamber 41. Thus, movement of the male terminal 1 in a direction of coming off from the terminal housing chamber 41 is inhibited. When another male terminal 1 is inserted into the terminal housing chamber 41 in which the male terminal 1 is already housed, the tab-entry-prevention part 15 blocks the insertion of the other male terminal 1. Thus, a situation in which a plurality of male terminals 1 is housed in one terminal housing chamber 41 can be prevented.

Explanations will be made further regarding the terminal 1. When the plate before bending (intermediate body 81) is viewed from the thickness direction, a conductor section (a rectangular portion as illustrated by oblique lines in FIG. 9) 85 as a conducting path having a cross-section that has constant width and thickness extends from the terminal contact part 20 (more precisely from a part of the terminal contact part 20 at the rear side than two cutouts 83 of a triangular shape) to the electrical wire connecting part 30 (front end of the electrical wire connecting part 30). That is, the conductor section 85 of a rectangular shape in which cutouts or through holes do not exist and deficiency of the material does not exist extends from the terminal contact part 20 to the electrical wire connecting part 30.

While the conductor section 85 is made to extend from the terminal contact part 20 to the front end of the electrical wire connecting part 30, as can be understood from FIG. 9, it can be considered that the conductor section 85 extends from the terminal contact part 20 to the rear end of the conductor connecting part 31, or it can be considered that the conductor section 85 extends to the rear end of the electrical wire connecting part 30, that is, over the whole length of the intermediate body 81.

The terminal contact part 20 is provided on the front side of the body part 2 with the first tapered coupling part 19 in between. In order to prevent breaking etc. of the material at the time of generating the terminal 1 by bending the intermediate body 81, a bending angle of the first tapered coupling part 19 with respect to the side wall portion 87 (bending angle with respect to the bottom wall portion 89 or the bottom wall 3) is made to gradually become larger as it goes from the body part 2 toward the terminal contact part 20.

To explain in detail, when the intermediate body 81 is viewed from this thickness direction, as illustrated in FIGS. 3B and 9, the terminal contact part 20 is formed in a rectangular shape elongated in the longitudinal direction. The first tapered coupling part 19 is formed in an isosceles trapezoid shape and constitutes a part of the conductor section 85 having the constant width, and the height direction of the isosceles trapezoid corresponds to the longitudinal direction. Also, the upper base of the first tapered coupling part 19 coincides with the rear end of the terminal contact part 20, and the lower base coincides with a part of the front end of the body part 2.

The terminal contact part 20 includes a bottom wall portion 91 and a pair of side wall portions 93. One side wall portion of the pair of side wall portions 93 of the terminal contact part 20 is located on one side in the width direction (up-and-down direction in FIGS. 3B and 9) of the bottom wall portion 91 of the terminal contact part 20. The other side wall portion of the pair of side wall portions 93 of the terminal contact part 20 is located on the other side in the width direction of the bottom wall portion 91 of the terminal contact part 20.

In a case that the terminal 1 is generated by bending, each of the pair of side wall portions 93 of the terminal contact part 20 is bent approximately 180 degrees with respect to the bottom wall portion 91 along line "a" as illustrated in FIG. 3B.

Further, in a case that the terminal 1 is generated by bending, each of the first side wall 4 and the second side wall 5 is bent approximately 90 degrees with respect to the bottom wall 3 along line "a" as illustrated in FIG. 3B.

The first tapered coupling part 19 includes a bottom wall portion 89 and a pair of side wall portions 87. One side wall portion of the pair of side wall portions 87 of the first tapered coupling part 19 is located on one side in the width direction of the bottom wall portion 89 of the first tapered coupling part 19. The other side wall portion of the pair of side wall portions 87 of the first tapered coupling part 19 is located on the other side in the width direction of the bottom wall portion 89 of the first tapered coupling part 19.

In a case that the terminal 1 is generated by bending, each of the pair of side wall portions 87 of the first tapered coupling part 19 is bent with respect to the bottom wall portion 89 along line "a" as illustrated in FIG. 3B.

A bending angle at the first tapered coupling part 19 (bending angle of the side wall portion 87 with respect to the bottom wall portion 89) is approximately 90 degrees at a place contacting the body part 2 and approximately 180 degrees at a place contacting the terminal contact part 20. Further, the bending angle (bending angle of the side wall portion 87 with respect to the bottom wall portion 89) gradually becomes larger as it goes from the place contacting the body part 2 toward the place contacting the terminal contact part 20 (see FIG. 3A).

The second slit 12 which opens on the side end face 7*a* is provided at the auxiliary wall 7, and the stabilizer 13 is formed by a separated portion on the front side of the second slit 12, and the tab-entry-prevention part 15 is formed by a portion on the rear side of the second slit 12. The first slit 8 that opens on the side end face 6*a* of the top wall 6 is provided at the top wall 6, and the stabilizer reinforcing section 9 is formed by a separated portion on the front side of the first slit 8, and the engagement section 10 is formed by a portion on the rear side of the first slit 8. Accordingly, by simply forming the first slit 8 on the top wall 6 and the second slit 12 on the auxiliary wall 7, the stabilizer reinforcing section 9, the engagement section 10, the stabilizer 13, and the tab-entry-prevention part 15 are provided by utilizing the separated portions by the first slit 8 and the separated portions by the second slit 12 without forming a hole as in the conventional terminal, and thus, it becomes possible to shorten the dimension L1 in the longitudinal direction of the body part 2. Accordingly, it is possible to make the electrical resistance small by downsizing the box-shaped body part 2 and the electric performance of the male terminal 1 can be improved.

Moreover, according to the terminal 1, when the plate (the intermediate body) 81 before bending is viewed from its thickness direction, the conductor section 85 (see the oblique lined part in FIG. 9) as the conducting path having a cross-section that has constant width and thickness in which deficiency of the material such as cutouts or through holes does not exist extends from the terminal contact part 20 to the electrical wire connecting part 30. Thus, an increase in the electrical resistance of the conducting path from the terminal contact part 20 to the electrical wire connecting part 30 can be prevented, and therefore, the electrical performance of the terminal 1 can be improved.

In other words, when considering in sheet resistance, it is possible to make the electrical resistance smaller when a cross-sectional area of the material that constitutes the terminal 1 is larger. Deficiency of the material does not exist in the portion as illustrated by oblique lines in FIG. 9 (the portion that includes not only the bottom wall 3, the bottom wall portion 89 of the first tapered coupling part 19, and the bottom wall portion 91 of the terminal contact part 20, but also the first side wall 4, the second side wall 5, the side wall portions 87 of the first tapered coupling part 19, and the side wall portions 93 of the terminal contact part 20). Therefore, in the terminal 1 according to the embodiment, it is possible to make the conducting path wider as compared with the conventional terminal, and thus, it is possible to make the electrical resistance smaller.

Moreover, according to the terminal 1, in bending the intermediate body 81 to generate the terminal 1, since the first tapered coupling part 19 is provided, there is no place in which a bending angle changes suddenly, and thus, generation of a crack and the like to the intermediate body 81 can be prevented and an increase in the electrical resistance of the conducting path can be further restrained.

Also, according to the terminal 1, the engagement section 10 is formed by raising a place at a part of the top wall 6 more than the other places, rather than providing a cutout or a through hole to the top wall as in the conventional terminal described in PTL 1, and thus, it is possible to reduce the quantity of scrap material generation caused by generation of the cutouts and the like.

Furthermore, by forming the engagement section 10 on the top wall 6 by plastic deformation, rigidity of the top wall 6 is enhanced as compared to a case in which it is formed into a plane form.

What is claimed is:

1. A terminal formed by bending a plate of conductive metal and housed in a connector housing, comprising:

a body part having a box-shape, comprising a bottom wall, a first side wall raised from one side end of the bottom wall, a second side wall raised from the other side end of the bottom wall, a top wall extended from the first side wall, and an auxiliary wall extended from the second side wall;

a terminal contact part provided on a front side of the body part;

an electric wire connecting part provided on a rear side of the body part;

a first slit which is provided on the top wall and which opens on a side end face of the top wall;

a second slit which is provided on the auxiliary wall and which opens on a side end face of the auxiliary wall;

a stabilizer formed by a separated portion on a front side of the second slit of the auxiliary wall;

a tab-entry-prevention part formed by a portion on a rear side of the second slit of the auxiliary wall;

a stabilizer reinforcing section formed by a separated portion on a front side of the first slit of the top wall; and an engagement section formed by a portion on a rear side of the first slit of the top wall, wherein when the plate before bending is viewed from its thickness direction, a conductor section having a cross-section having constant width and thickness extends from the terminal contact part to the electrical wire connecting part.

2. The terminal according to claim 1, wherein the terminal contact part is provided on a front side of the body part with a tapered coupling part in between, and a bending angle of a side wall portion of the tapered coupling part with respect to the bottom wall is made to gradually become larger as it goes from the body part toward the terminal contact part.

3. The terminal according to claim 1, wherein the engagement section is formed by raising a place at a part of the top wall more than the other places of the top wall.

* * * * *